United States Patent [19]

Reindel

[11] 4,023,123

[45] * May 10, 1977

[54] MICROSTRIP REVERSE-PHASED HYBRID RING COUPLER

[75] Inventor: John Reindel, San Diego, Calif.

[73] Assignee: The United States of America as represented by the Secretary of the Navy, Washington, D.C.

[ * ] Notice: The portion of the term of this patent subsequent to Apr. 13, 1993, has been disclaimed.

[22] Filed: Feb. 3, 1975

[21] Appl. No.: 546,369

[52] U.S. Cl. ..... 333/11; 333/84 M

[51] Int. Cl.[2] ..... H01P 5/16

[58] Field of Search ..... 325/445, 446; 333/735, 333/84 M, 97 R, 11, 6, 10

[56] References Cited

UNITED STATES PATENTS

| | | | |
|---|---|---|---|
| 2,436,828 | 3/1948 | Ring | 325/446 |
| 2,854,645 | 9/1958 | Arditi | 333/84 M |
| 3,506,932 | 4/1970 | Beurrier | 333/84 M |
| 3,611,233 | 10/1971 | Haldeman, Jr. | 333/84 M |
| 3,950,703 | 4/1976 | Reindell | 325/446 |

*Primary Examiner*—John C. Martin

*Attorney, Agent, or Firm*—R. S. Sciascia; G. J. Rubens; H. Fendelman

[57] ABSTRACT

A microstrip hybrid directional coupler in which the 180° phase shift is effectuated by a twisted pair of parallel conductors.

14 Claims, 4 Drawing Figures

FIG. 3
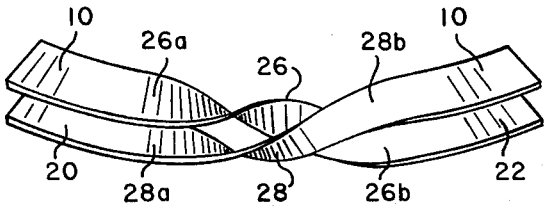
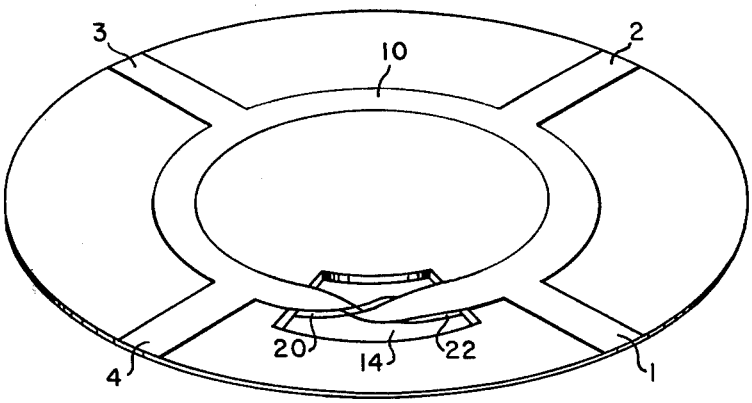
FIG. 4

MICROSTRIP REVERSE-PHASED HYBRID RING COUPLER

BACKGROUND OF THE INVENTION

The hybrid ring circuit, the so called rat race, has been used for many years and is still an essential part of many complex microwave circuits such as mixers, filters, phase shifters and power dividers. The rat race has three of the four transmission lines between ouput ports equal to one quarter wavelength and one line equal to three quarter wavelengths at midband. The isolation between any two opposite ports is infinite at midband because the two path lengths differ by exactly 180°, but drops rapidly with a change in frequency due to the change in relative path lengths. The useful bandwidth is about 10%.

A modified ring circuit is described in "A Wide Band Hybrid Ring for UHF" by W. V. Tyminski, proceedings of IRE, January 1953, p. 81–87 and is useful over greater than an octave bandwidth. The modified hybrid ring described therein has four transmission lines between output ports each equal to one quarter wavelength at midband and provides an even 3 db power split. The device, however, was originally used only in the low UHF band because it could not be fabricated for use at higher frequencies. A balanced-line hybrid for extending the operation into the microwave region was described by J. W. Carr in the Microwave Journal, May 1973, p. 49–52.

SUMMARY OF THE INVENTION

The present invention relates to a microstrip directional coupler suitable for use in many complex microwave circuits such as mixers, power dividers, feed matrices and filters. The performance of the present invention is superior to all known prior art couplers, has a wider operational bandwidth and is useful at EHF. The reverse phased coupler of the present invention may be used for any degree of coupling from about 3 to 10 db.

STATEMENT OF THE OBJECTS OF THE INVENTION

Accordingly, it is the primary object of the present invention to disclose a novel directional coupler.

It is a further object of the present invention to disclose a novel hybrid ring type coupler.

It is yet another object of the present invention to disclose a novel means for introducing a 180° phase reversal.

Other objects, advantages and novel features of the invention will become apparent from the following detailed description of the invention when considered in conjunction with the accompanying drawings.

BRIEF DESCRIPTION OF THE DRAWINGS

FIG. 3 is a detailed perspective of the 180° twisted pair of transmission lines of the present invention.

FIG. 4 is a perspective view of the ring coupler of the present invention.

DESCRIPTION OF THE PREFERRED EMBODIMENT

Figure 1:
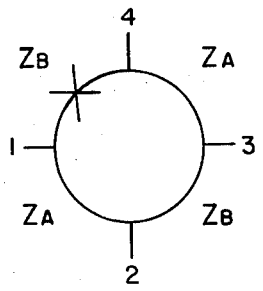
FIG. 1 is a schematic representation of the reverse phased hybrid of the present invention.

According to the present invention, the reverse-phased ring has all four arms equal to one quarter wavelength at midband. One of the arms is formed as a pair of parallel transmission lines and is given a twist which effectively adds a 180° phase reversal to that arm as illustrated in FIG. 1 wherein the twist is indicated by an X. Because the reverse phased ring is symmetrical, i. e., the two path lengths to the isolated port are exactly equal at all frequencies, the isolation is infinite at all frequencies and the power split does not vary. By varying the impedances of the circuit arms $Z_A$ and $Z_B$ between ports 1, 2, 3 and 4, the ratio of the output power from the ports can be varied. As an example, if impedance values of 48 and 150 ohms are assigned to $Z_A$ and $Z_B$, respectively, the power out ports 1 and 3 is approximately at 10.5 and 0.5 db, respectively, and varies less than 0.3 db from 6 to 20 GHz.

Figure 2:
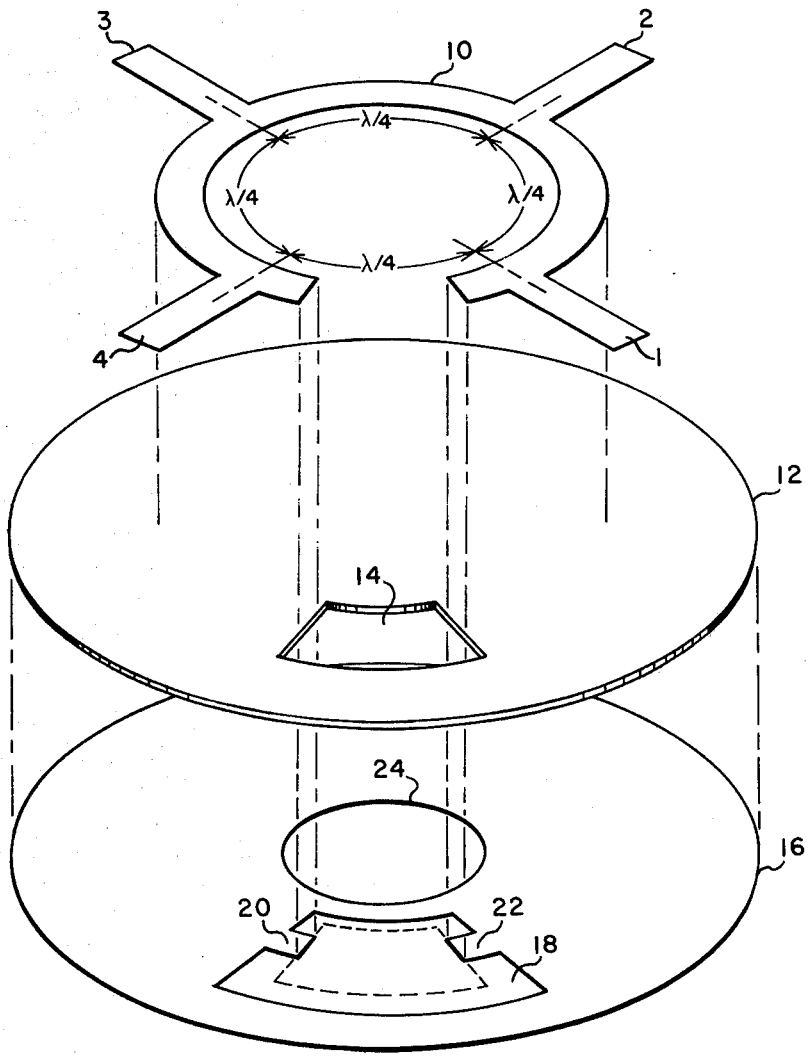
FIG. 2 is an exploded view of the ring coupler of the present invention.

The microcircuit reverse phased coupler of the present invention is illustrated in detail in FIGS. 2 and 4. With reference to those figures, the top signal divider circuit pattern 10 may comprise a printed copper circuit suitably applied to dielectric 12 which could be a laminate or Teflon impregnated fiberboard. The width of the circuit lines may be adjusted for the desired transmission line impedance, i.e., for a 3 db coupler the impedance is 70 ohms and with a 0.016 inch thick Teflon fiberglass laminate the width is about 0.020 inches. Aperture 14 is provided in laminate 12 such that the 180° twisted pair of transmission lines described below can be connected from the top circuit 10 to the bottom ground plane 16. Ground plane 16 which may comprise, for example, a copper plate suitably affixed to dielectric 12 is provided with a first cutout section 18. Ground plane projections 20 and 22 extend into aperture 18 and are the ground plane contact points for the 180° twisted pair of parallel transmission lines. In order to increase the device efficiency, ground plane 16 may also include a cutout section 24 concentric with but having a smaller diameter than the inner diameter of the top copper circuit. A suitable housing (not shown) may be provided around dielectric 12 into which coaxial connectors may be press fit for connecting the ring coupler terminals 1, 2, 3, and 4 to coaxial cables.

Details of the 180° twisted pair of parallel transmission lines is illustrated in FIG. 3. A first line 26 comprised of a metallic strip having a width equal to that of the conductor width of top circuit 10 is connected to top circuit 10 at a first end **26*a*. The metallic strip is given a 180° twist and extended through aperture 14 in dielectric 12 and is then connected to extension 22 of ground plane 16. It is noted that the 180° twist is such that the face of metallic strip 26 which contacts top circuit 10 at strip end 26*a* also contacts ground plane extension 22 at strip end 26*b* and that the face of metallic strip 26 that faces away from and is not in contact with top circuit 10 also faces away from and is not in contact with ground plane extension 22. Similarly, metallic strip 28 having the same width as 26 is connected at a first end 26*a* to ground plane extension 20, is twisted 180° in the same direction as the twist in metallic strip 26, extends through aperture 14 in dielectric 12 and contacts signal divider circuit 10 at strip end 28*b*. To insure proper device operation, it is important that strips 26 and 28** remain parallel and equally spaced throughout their lengths. This requirement provides uniform impedance throughout the twisted line length. These parallel, 180° twisted transmission lines thus provide a 180° phase shift to the signal passing through the circuit arm in which they are located and thus serve to isolate opposite device ports.

Obviously many modifications and variations of the present invention are possible in the light of the above teachings. It is therefore to be understood that within the scope of the appended claims the invention may be practiced otherwise than as specifically described.

What is claimed is:

1. A microwave directional coupler comprising:

a dielectric material having first and second sides;

a plurality of interconnected electrical conductors each of a predetermined electrical length fixed to said first side of said dielectric material;

a ground plane conductor fixed to said second side of said dielectric material;

a phase reversal transmission line connected to two of said plurality of electrical conductors comprising first and second adjacent, substantially parallel conductors each having first and second sides and each being twisted 180° whereby said phase reversal transmission line introduces a 180° phase reversal to microwave signals propagating therethrough.

2. The directional coupler of claim 1 wherein said first and second conductors are oriented such that said first side of said first conductor faces said first side of said second conductor throughout the lengths of said conductors.

3. The directional coupler of claim 2 wherein the distance between said first and second conductors is constant throughout the lengths of said first and second conductors.

4. The directional coupler of claim 3 wherein said first and second conductors are of equal electrical lengths.

5. The directional coupler of claims 2 wherein one end of each of said first and second conductors is connected to said ground plane conductor.

6. The directional coupler of claim 5 wherein said plurality of interconnected electrical conductors is three interconnected electrical conductors.

7. The directional coupler of claim 6 wherein each of said three electrical conductors and said phase reversal electrical conductor are of equal electrical lengths.

8. The directional coupler of claim 7 wherein said equal electrical lengths are $\lambda/4$ where $\lambda$ is the wavelength at the middle of the operational frequency band.

9. The directional coupler of claim 5 including a port connected to the junction of each of said plurality of electrical conductors and a port connected to the junction of each of said two of said plurality of electrical conductors with said phase reversal conductor.

10. The directional coupler of claim 9 wherein each of said plurality of electrical conductors and said phase reversal conductor are of equal electrical length of $\lambda/4$ where $\lambda$ is the wavelength at the middle of the operational frequency band.

11. The directional coupler of claim 10 wherein said plurality of interconnected electrical conductors is three interconnected electrical conductors.

12. The directional coupler of claim 11 wherein said first and second conductors are of equal width.

13. The directional coupler of claim 12 wherein said first and second conductors are of equal electrical lengths.

14. The directional coupler of claim 13 wherein said first and second conductors extend through an aperture in said dielectric material.

* * * * *